United States Patent [19]

Sahrbacker

[11] Patent Number: 4,705,920

[45] Date of Patent: Nov. 10, 1987

[54] ELECTRICAL SWITCH WITH ROCKER ACTUATOR HAVING REMOVABLE LOCKING KEY

[75] Inventor: Edward V. Sahrbacker, Brecksville, Ohio

[73] Assignee: Lucerne Products, Inc., Hudson, Ohio

[21] Appl. No.: 849,464

[22] Filed: Apr. 8, 1986

[51] Int. Cl.[4] ..... H01H 27/00

[52] U.S. Cl. ..... 200/43.04; 200/157; 200/16 C; 200/68.3

[58] Field of Search ..... 200/43.01, 43.04, 43.07, 200/339, 243, 16 C, 16 R, 68.3, 157

[56] References Cited

U.S. PATENT DOCUMENTS

| | | | |
|---|---|---|---|
| Re. 30,273 | 5/1980 | Grebner et al. | 200/43.04 |
| 3,222,488 | 12/1965 | Matthews | 200/243 |
| 3,415,966 | 12/1968 | Matthews | 200/153 R |
| 3,536,973 | 10/1970 | Matthews et al. | 318/345 R |
| 3,598,934 | 8/1971 | O'Connor, III | 200/16 C |
| 3,610,860 | 10/1971 | Baldwin | 200/31 S |
| 3,681,556 | 8/1972 | Osika | 200/339 X |
| 3,739,126 | 6/1973 | Sahrbacker et al. | 200/157 |
| 3,745,286 | 7/1973 | Sahrbacker | 200/157 |
| 4,013,858 | 3/1977 | Grebner et al. | 200/43.04 |
| 4,064,380 | 12/1977 | Matthews | 200/16 C |
| 4,168,416 | 9/1978 | Josemans | 200/43.04 |
| 4,174,472 | 11/1979 | Josemans | 200/43.04 |
| 4,230,917 | 10/1980 | Osika | 200/43.04 |
| 4,291,207 | 9/1981 | Reinke et al. | 200/43.04 |
| 4,352,965 | 10/1982 | Sorenson | 200/6 R |
| 4,383,154 | 5/1983 | Sorenson | 200/325 |
| 4,440,994 | 4/1984 | Nat | 200/43.04 |

FOREIGN PATENT DOCUMENTS

| | | | |
|---|---|---|---|
| 847851 | 9/1960 | United Kingdom | 200/43.04 |

*Primary Examiner*—Henry J. Recla
*Assistant Examiner*—Ernest G. Cusick
*Attorney, Agent, or Firm*—Baldwin, Egan, Hudak & Fetzer

[57] ABSTRACT

An electrical switch actuated by a longitudinally reciprocable electrical contact carrier, with such reciprocation being brought about by a two-piece rocker actuator with one of the actuator pieces comprising a removable locking key which when removed from the actuator assembly prevents movement of the contact carrier and thus prevents actuation of the switch.

5 Claims, 20 Drawing Figures

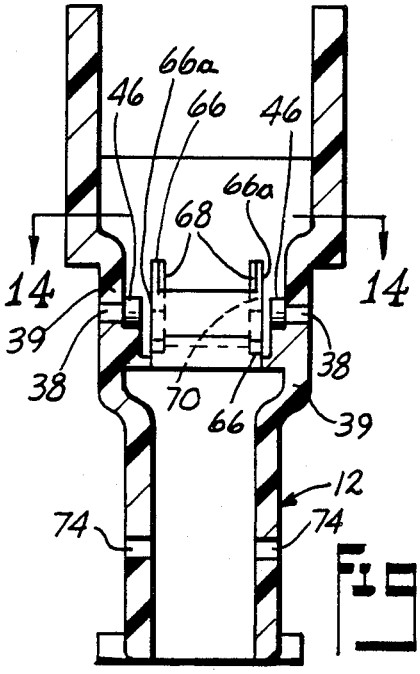
Fig 13
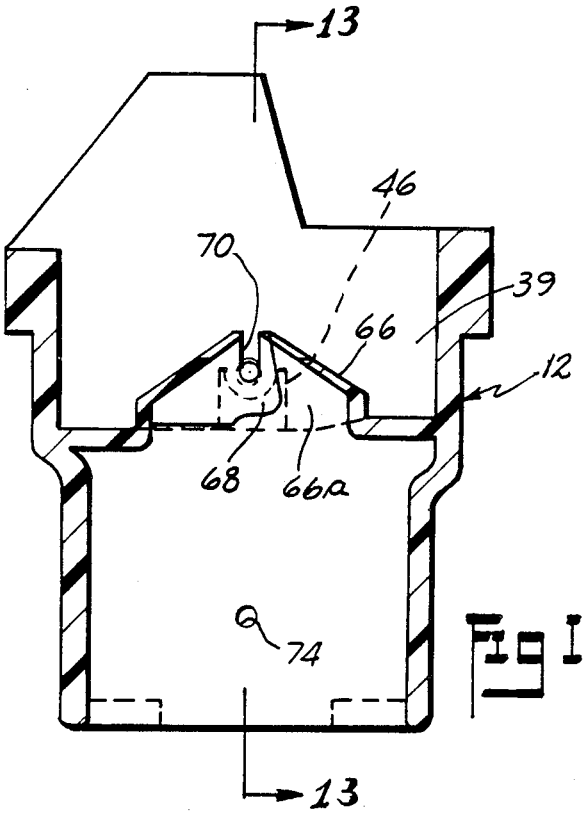
Fig 12
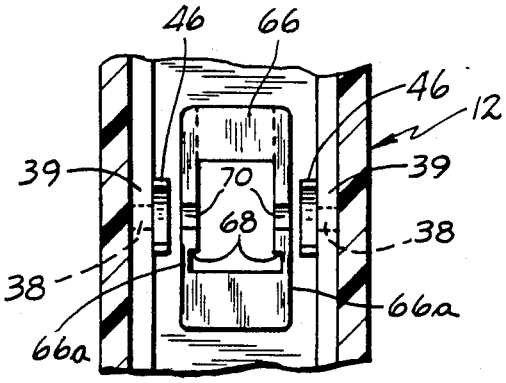
Fig 14
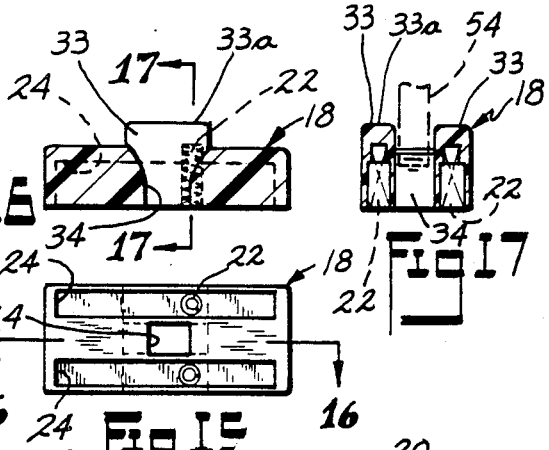
Fig 16
Fig 17
Fig 15
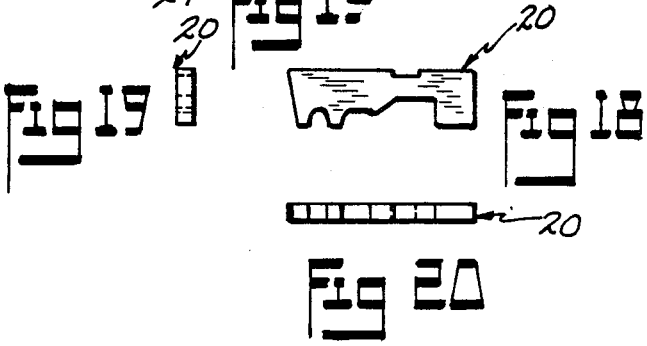
Fig 19
Fig 18
Fig 20

ELECTRICAL SWITCH WITH ROCKER ACTUATOR HAVING REMOVABLE LOCKING KEY

This invention relates in general to electrical switches for controlling electrical energy, such as for instance as used in electric motor driven tools, and which includes a longitudinally slidable electrical contact carrier actuated by a rocker type actuator, and more particularly relates to an electrical switch of the latter type which includes a removable locking key as part of the actuator assembly, which when removed from the assembly, prevents movement of the carrier and thus prevents actuation of the switch.

BACKGROUND OF THE INVENTION

Combination reciprocable electrical contact carrier and rocker actuator switches are known in the art. However, to applicant's knowledge, heretofore no one has provided a combined reciprocal contact carrier-rocker actuator switch with means for locking the switch in one position. For instance, the switch of the present invention can be readily locked in "off" position so that it cannot be actuated to "on" position unless the removed actuator key of the actuator assembly is reinserted into the switch mechanism.

SUMMARY OF THE INVENTION

The present invention provides a novel electric switch for controlling electrical energy and which comprises a longitudinally reciprocal electrical contact carrier and a coacting rocker actuator for moving the carrier so as to actuate the switch from "off" position to "on" position and vice versa, and which includes means for selectively locking the carrier in predetermined switch position.

A further object of the invention is to provide a switch of the aforementioned type wherein the means for locking the carrier in predetermined switch position comprises a two-piece rocker actuator, one of which actuator pieces is pivoted to the switch housing, and the other of which actuator pieces comprises a removable locking key and which when assembled with said one actuator piece extends into coaction with the carrier for providing for actuation of the carrier, and which in one position of the switch is removable from the actuator assembly and when so removed, prevents actuation of the switch.

A still further object of the invention is to provide a switch of the aforementioned type including means for preventing removal of said other actuator piece from the actuator assembly, and wherein such means comprises a lug on said other actuator piece which coacts in interfering relationship with respect to a shoulder on the switch housing when the switch is in predetermined actuated position, so as to prevent said other actuator piece from being withdrawn from the switch assembly, but which in another position of the actuator assembly, provides for withdrawal of said other actuator piece from the switch, and which when so withdrawn prevents further actuation of the switch.

Other objects and advantages of the invention will be apparent from the following description taken in conjunction with the accompanying drawings wherein:

BRIEF DESCRIPTION OF THE DRAWINGS

FIG. 12 is a longitudinal vertical sectional view of the housing of the switch of the invention illustrating a shoulder on the shroud portion of the housing adapted for coaction with a lug on the locking key in the "on" position of the switch, for preventing removal of the locking key from the switch;

FIG. 13 is a vertical sectional view taken generally along the plane of line 13—13 of FIG. 12 looking in/the direction of the arrows;

FIG. 14 is a fragmentary, horizontal sectional view taken generally along the plane of line 14—14 of FIG. 13 looking in the direction of the arrows;

FIG. 15 is a bottom plan view of the reciprocal electrical contact carrier member of the switch assembly;

FIG. 16 is a sectional view taken generally along the plane of line 16—16 of FIG. 15 looking in the direction of the arrows;

FIG. 17 is a vertical sectional view taken generally along the plane of line 17—17 of FIG. 16 looking in the direction of the arrows, and illustrating in phantom lines a portion of the coacting finger of the actuator locking key;

FIG. 18 is a side elevational view of one of the movable electrical contacts of the switch assembly;

FIG. 19 is an end elevational view of the contact of FIG. 18, taken from the righthand end thereof; and FIG. 20 is a bottom plan view of the contact of FIGS. 18 and 19.

DESCRIPTION OF PREFERRED EMBODIMENT

While the invention is described herein especially with reference to its application in electric tools, it will be understood that it may be used in other applications to control the application of electric energy to an applied load.

Referring now in particular to FIGS. 1 through 5 there is shown an electrical switch 10 embodying the invention, and including a switch housing 12 of molded electrical insulating, plastic material. Housing 12 on the ends thereof may be provided with generally resilient spring arms 14 by which the housing may be readily retained in a suitable opening in a motor driven tool. Stops 15 may be provided on the housing exterior for limiting the maximum inward flexure of arms 14 relative to the housing.

Figure 4:
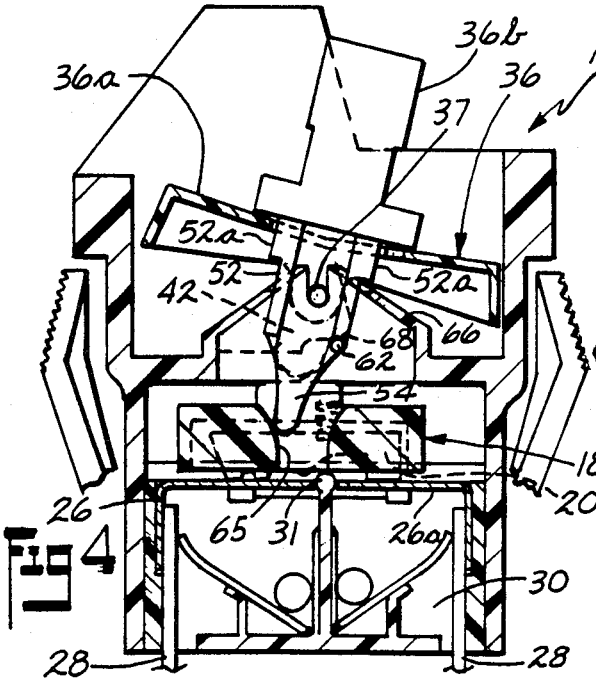
FIG. 4 is a partially broken, vertical sectional view of the switch of FIGS. 1–3, with the rocker actuator assembly having been pivoted to cause the switch to be actuated to "on" condition.
Figure 11:
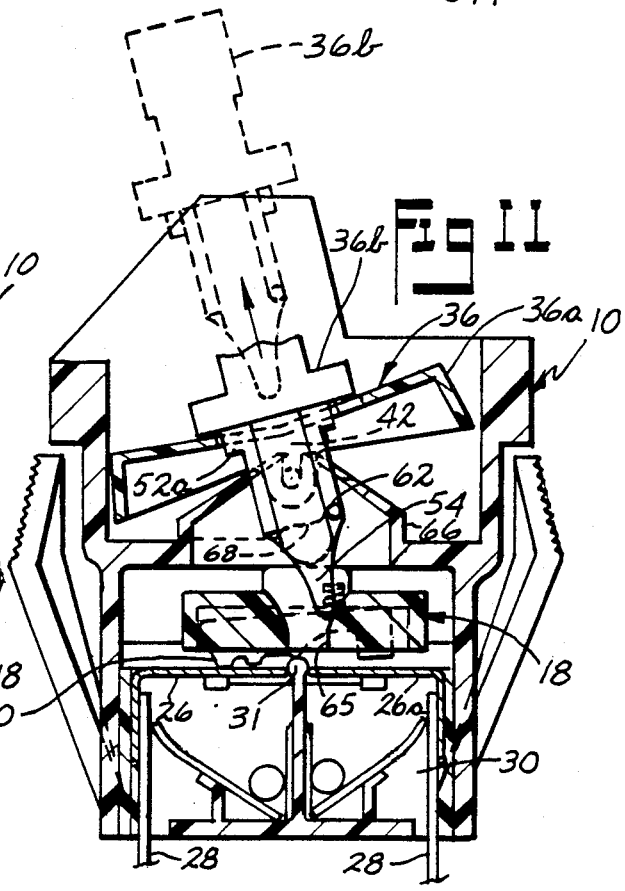
FIG. 11 is a longitudinal vertical sectional view of the switch generally similar to that of FIG. 4, but with the rocker actuator having been moved to "off" position thus deactivating energy flow through the switch, and showing in phantom lines in the direction of the arrow, the removal of the locking key from the actuator assembly in said "off" position of the switch, thus preventing actuation of the switch from said "off" position.

A switch device 16 is disposed in the housing 12 and comprises a contact carrier 18 (FIGS. 15–17) which is reciprocable generally linearly, longitudinally or lengthwise thereof as seen in FIGS. 4 and 11, and within which is carried in the embodiment illustrated a pair of movable electrical contact means, as for example the bridge electrical contact members 20 (FIGS. 18, 19 and 20). Springs 22 (FIG. 17) disposed in a respective bore in the carrier, are provided for resisting the pivotal movement of the respective contact member 20 in its respective slot 24 (FIG. 15) in the carrier 18, with such movable contact being movable from an "on" position as shown for instance in FIG. 4 to an "off" position as shown for instance in FIG. 11.

As seen in FIGS. 4 and 11, the switch device illustrated comprises two longitudinally spaced stationary electrical contact members 26, **26*a*, with there being a similar pair of stationary contacts (not shown) on the opposite side of the switch structure. Each stationary contact is provided with electrical power connections, as shown at 28. These parts, as illustrated, are carried by plastic module 30, so as to be insertable and removable from the switch housing as a unit from the bottom of housing 12. An upwardly extending projection 31 is provided on the module located between each respective pair of the contacts 26, 26*a*, for causing the movable bridging contact 20 to be pivoted from the "on" position shown in FIG. 4 with the movable contact 20 being in engagement with and bridging the respective pair of stationary contacts 26, 26*a*, until the contact 20 as actuated by carrier 18 reaches a position to the right of that of FIG. 4, whereupon the righthand end of the contact 20 will be raised upwardly out of contact with the underlying fixed contact 26*a*, in the switch "off" position. It will be seen from FIG. 15 that in the embodiment illustrated the carrier 18 supports two of the movable bridging contacts (e.g. 20) in side-by-side relationship, with each bridging contact being disposed in and being movable vertically in the respective of the two parallel channels or slots 24 in the underside of the contact carrier 18**. Reference may be had to U.S. Pat. No. 3,222,488 dated Dec. 5, 1965 and U.S. Pat. No. 3,415,966 dated Dec. 10, 1968 for a more complete discussion of a movable contactor switch of the general type disclosed herein, which references are incorporated herein by reference.

Referring now in particular to FIGS. 16 and 17, the carrier 18 also comprises a pair of laterally spaced upstanding boss portions 33 on the top thereof, intermediate its ends. Such boss portions 33 preferably have generally flat horizontal top surfaces **33*a* thereon and are for a purpose to be hereinafter described. Carrier 18 also has a central vertical aperture 34 therethrough for a purpose to be hereinafter described. It will be understood that each of the movable bridging contacts 20 upon engagement with the respective camming portion 31 on the module 30 which supports the stationary contacts, is caused to be moved against the resistance of the associated spring 22 from an "on" position to an "off" position during lengthwise generally linear movement of the associated carrier 18**, and as described in the aforementioned patents.

Figure 2:
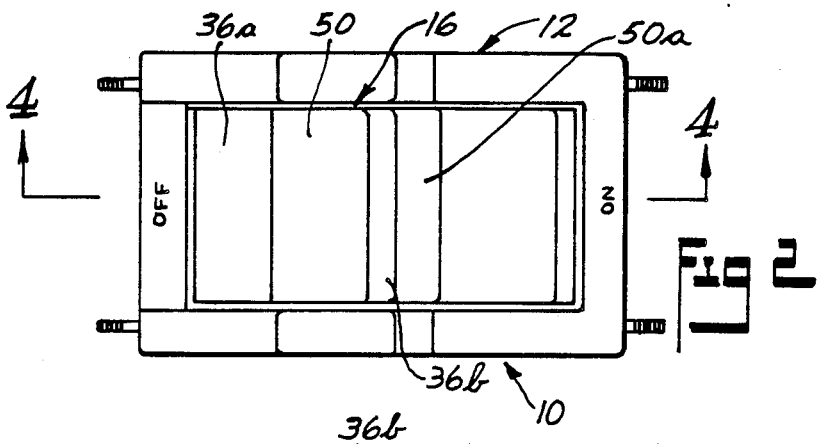
FIG. 2 is a top plan view of the switch of FIG. 1.
Figure 1:
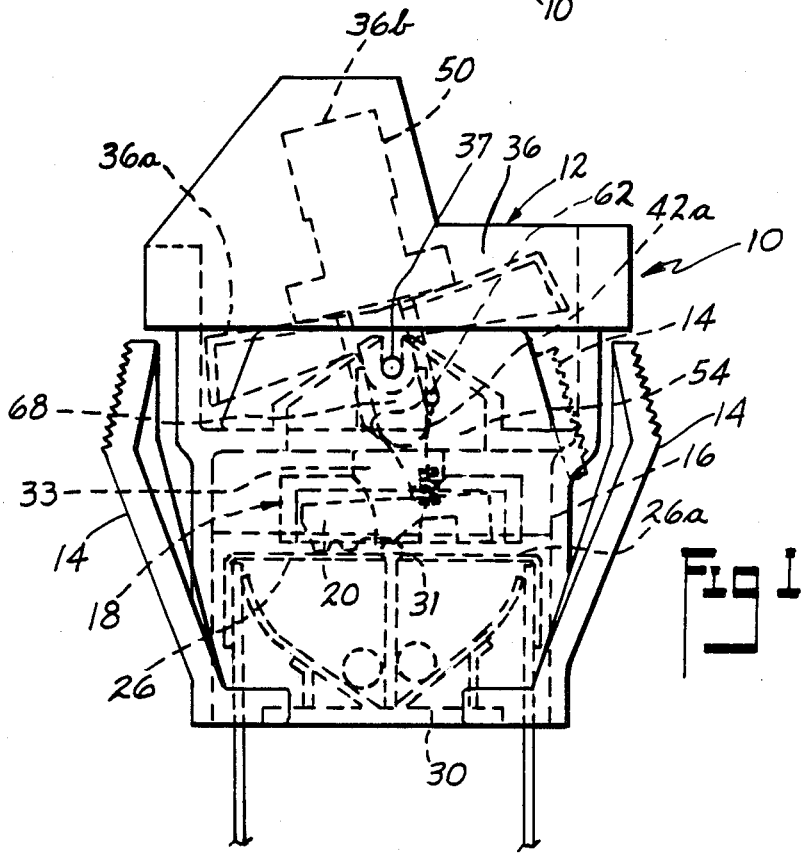
FIG. 1 is a side elevational view of an electrical switch embodying the invention.
Figure 3:
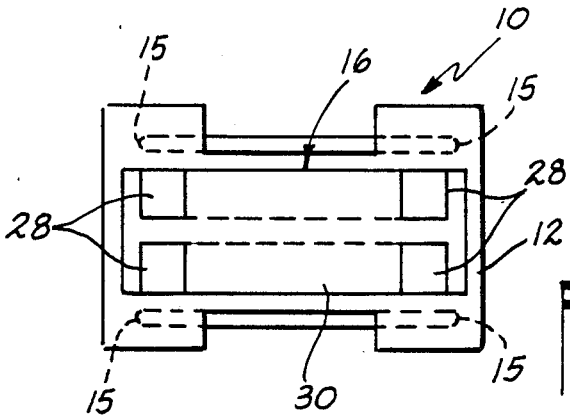
FIG. 3 is a bottom plan view of the switch of FIG. 1, but with the elongated serrated retaining arms on the switch housing having been deleted.
Figure 6:
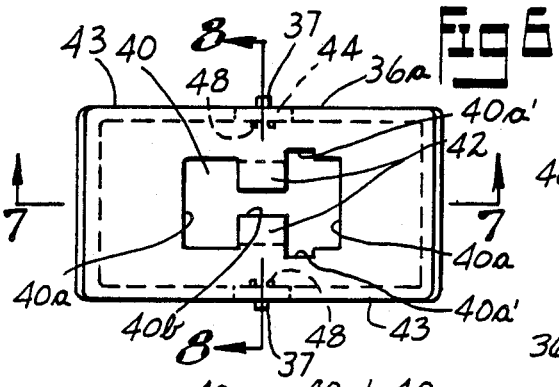
FIG. 6 is a top plan view of the pivotal rocker button portion of the rocker actuator assembly of the switch of FIGS. 1 through 5.
Figure 8:
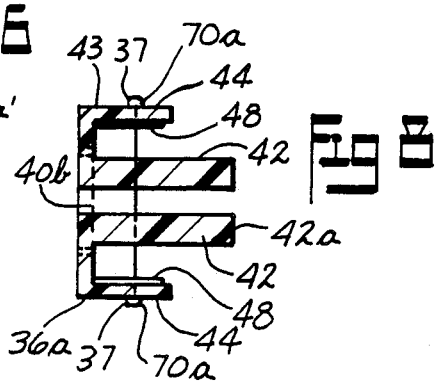
FIG. 8 is a sectional view taken generally along the plane of line 8—8 of FIG. 6 looking in the direction of the arrows.
Figure 7:
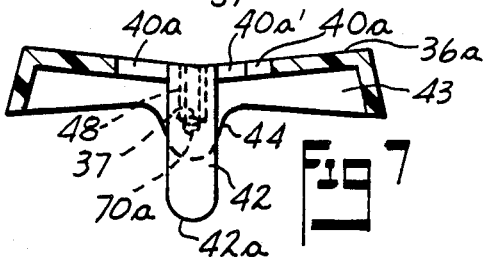
FIG. 7 is a sectional view taken generally along the plane of line 7—7 of FIG. 6, looking in the direction of the arrows.

The novel rocker actuator assembly 36 of the present arrangement for causing longitudinal or linear movement of the contact carrier 18, comprises a two-piece assembly. One piece of the actuator assembly 36 is a rocker or pivotal type operating member **36*a* having laterally projecting lugor trunnion means 37 on the exterior sides thereof (FIGS. 6, 7 and 8). Such lugor trunnion means are adapted to be received in complementary openings 38 in the side walls 39 of the switch housing 12, for pivotally mounting the operating member 36*a*** with respect to the housing.

As can be best seen in FIG. 6, the rocker member **36*a* has a vertical opening 40 therethrough comprising a pair of spaced opening sections 40*a* spaced lengthwise of member 36*a* and connected by a channel section 40*b*, the purpose of which opening sections will be hereinafter described. A pair of laterally spaced leg portions 42 extend downwardly from the defining top wall of the rocker member 36*a* with such leg portions preferably having generally convex surfaces 42*a* on their lower ends as best shown in FIG. 7. The side walls 43 of the rocker member 36*a* are also provided with arcuate bearing portions 44 which are adapted to be received in complementary arcuate bearing portions 46 (FIGS. 12 and 13) formed on the inner sides of the side walls 39 of the switch housing, when the rocker member 36*a* is pivotally mounted on its trunnions 37 thereon extending into the respective opening 38 in the side walls of the housing. In the embodiment illustrated the rocker member 36*a* is also preferably provided with a pair of spaced ribs 48 on the inner surface of each side wall 43 thereof, which ribs provide for feeding of plastic material to the trunnions during the molding of the member, and which ribs 48 also strengthen the bearing sections 44** of the rocker member.

Figure 10:
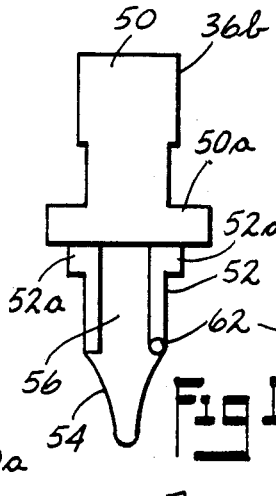
FIG. 10 is a side elevational view of the locking key of FIG. 9, taken from the lefthand side thereof.
Figure 9:
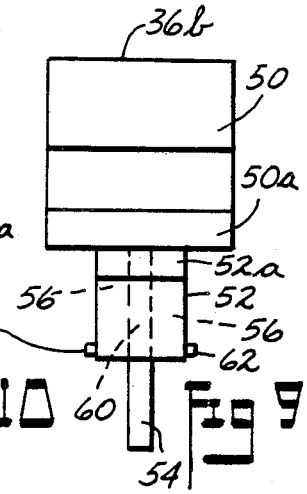
FIG. 9 is an end elevational view of the locking key per se of the actuator assembly in the switch of the invention.
Figure 5:
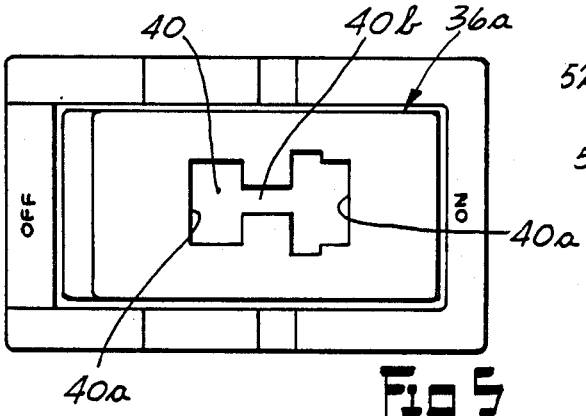
FIG. 5 is a top plan view of the housing of the switch of FIGS. 1 through 3 with the lever-like locking key having been removed therefrom.

The other piece of the actuator assembly 36 comprises a removable lever-like locking key **36*b* (FIGS. 9 and 10) which includes in the embodiment illustrated a head portion 50 including a base section 50*a*, an arm portion 52 extending downwardly from the head portion 50, and a finger portion 54 projecting downwardly from the arm portion. The base section 50*a* is adapted to rest on the top surface of the rocker member 36*a* in the assembled condition of the actuator 36. The arm portion 52 of the locking member 36*b* includes projecting shoulder portions 52*a* which are adapted to be received in generally close fitting relation in the aforementioned opening sections 40*a* in the rocker member 36*a* for locating and positioning the locking key piece 36*b* of the actuator with respect to the rocker member piece and in upwardly and downwardly extending relation thereto. The arm portion 52 also has channels 56 formed on both sides thereof which are adapted to receive in relative sliding relation the leg portions 42*a* of member 36*a* upon assembly of the locking key 36*b* with rocker member 36*a***.

The finger portion 54 of member 36b is adapted to be received within the aforementioned aperture 34 in the carrier 18 for causing the reciprocal longitudinal movement of the carrier as aforedescribed for actuation of the switch. The channels 56 on both sides of the locking key member 36b define a central web 60 with the finger portion 54 being an extension of the web 60.

Member 36b is adapted to be received through opening 40 in the rocker member 36a with the leg portions 42 of the rocker member being received in the channel sections 56 of member 36b and with web 60 of member 36b received in channel section 40b of member 36a, in relatively slidable relationship. The righthand (with reference to FIG. 6) opening section of opening 40 includes laterally spaced widened sections 40a' for receiving therethrough the lugs 62 projecting laterally of the arm portion 52 from both sides of the locking key. Lugs 62 will pass through the opening 40 via the widened sections 40a' thereof for permitting entry assembly movement of the key member 36b through the opening 40 so as to assemble member 36b with member 36a.

It will be seen that if an attempt is made to assemble member 36b in a 180° rotated position from its correct entry position, whereby the lugs would attempt to pass through the lefthand (with reference to FIG. 6) opening section 40a, that the lugs 62 on member 36b would prevent assembly movement of member 36b through opening 40. With the key member 36b properly assembled with the rocker member 36a of the actuator assembly, the head portion 50 projects upwardly to form an actuating lever-like portion, while the leg portions 42 of the rocker member 36a are received in the respective side channel 56 of the key member 36b as shown for instance in FIG. 4, with the finger portion 54 of the key member extending downwardly below the leg portions 42 and into coacting relationship in opening 34 of the electrical contact carrier 18. Opening 34 preferably has inwardly and downwardly sloped end surfaces 65 for accommodating angular entry of the finger 54 therein without binding.

Referring now in particular to FIGS. 12, 13 and 14, it will be seen that the housing 12 includes a shroud section 66 which in the embodiment illustrated is formed integrally with the housing, with each side wall 66a of the shroud including a shoulder contour 68 which projects laterally inwardly of the shroud. As can be seen, the shroud opens upwardly at the top thereof, and also is open on the underside thereof for access to the contact carrier 18.

When the actuator assembly 36 is rocked or pivoted to "on" position as shown in FIG. 4, to thus cause linear movement of the carrier 18 and movement of the movable contacts 20 into engagement with the respective underlying stationary contacts 26, 26a, the lug 62 on each respective side of key member 36b of the actuator is disposed beneath the opposing shoulder 68 as shown in FIG. 4, so that if an attempt is made to withdraw the key member 36b from the actuator assembly, the lugs 62 interfere with such withdrawal by engagement with the respective shoulder, and thus prevent withdrawal of the key 36b from the switch.

However, when the actuator assembly is swung or pivoted about its trunnions 37 to "off" position, as shown for instance in FIG. 11, so as to move the switch to "off" position by movement of the carrier 18 longitudinally, thus camming each movable contact 20 upwardly out of engagement with its underlying stationary contacts, the pivotal movement of the actuator 36 causes the lugs 62 on the key member 36b to be disposed laterally outwardly of the shoulders 68 and out of interfering relationship with respect thereto.

Accordingly, by merely pulling up on the head portion 50 of the key member 36b, the latter can be separated from the rocker member 36a of the actuator assembly 36, thus separating the key member from the actuator. In such a separated condition it will be seen that while the rocker member 36a can still be pivoted by means of depressing either end thereof, since there is no finger portion (e.g. 54) of the actuator extending into coaction with the carrier 18, the carrier is not moved even though the rocker member 36a is pivoted with respect to the housing. Accordingly, the switch is maintained in deactivated condition until such time as the key member 36b is reinserted into assembled relationship with respect to the rocker member 36a so that the finger portion 54 of the key member 36b extends through opening 40 in member 36a, and through the shroud 66 into coacting relation with the carrier 18. Thus with the key member removed from the actuator assembly, actuation of the switch is prevented.

It will be seen that the rocker member 36a with its depending bearing sections 44 are movably received within the complementary upwardly facing arcuate bearing portions 46 formed on the side walls 39 of the housing, with the trunnions 37 on the rocker member of the actuator assembly extending through the respective opening in the side wall, to pivotally mount the rocker 36a member on the housing.

The vertically elongated slots 70 in the side walls 66a of the shroud portion 66 are adapted for guiding the trunnions 37 on the rocker member downwardly toward the respective opening 38 in the side walls 39 of the housing during assembly of the rocker member with the housing. Once the trunnions are aligned with the respective opening, each trunnion snaps through the opening, to pivotally mount the rocker member 36a on the housing. In this connection it will be seen that each trunnion 37 preferably is chamfered on its under surface as at 70a, so as to facilitate the snapping of the trunnion into its respective opening 38.

The housing being formed of plastic has some "give" to it so that the rocker member 36a can be forced into its pivotal mounted condition on the housing walls, without damage to either the rocker member or the housing. It will be seen that the carrier member 18 and its associated contact module 30 are assembled from the bottom of the housing, with the module preferably having prongs (not shown) on the sides thereof which are adapted to snap into receiving openings (e.g. 74) in the enclosing housing wall, to retain the module in position in the housing.

From the foregoing discussion and accompanying drawings it will be seen that the invention provides a novel electric switch for controlling electrical energy, such as for instance in electrical motor driven tools, and which includes a rocker actuator that operates to supply longitudinal reciprocal movement to an electrical contact carrier of the switch, for actuating the switch device from "on" position to "off" position, and vice versa, with the actuator being comprised of two pieces, one of which is pivoted to the housing and the other which coacts with the pivoted piece and coacts with the carrier, for actuating the latter in its said reciprocal movement responsive to pivotal movement of the actuator, and wherein the other actuator piece is removed from the actuator assembly, actuation of the switch is prevented.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. An electric switch for controlling electrical energy such as for instance in electric motor driven tools comprising, a housing, a plurality of stationary electrical contacts mounted in said housing, an insulative contact carrier mounted in said housing and being movable relative thereto, movable electric contact means mounted on said carrier for coaction with said stationary contacts, said carrier being reciprocable generally linearly relative to said housing for moving said movable contact means relative to said stationary contacts and thus causing actuation of said switch from "off" to "on" position and vice versa, a rocker actuator pivotally mounted on said housing and coacting with said carrier for causing said movement of said carrier, said actuator being comprised of two pieces, one piece of which is pivoted to said housing and the other piece of which coacts with said one piece and coacts with said carrier for actuating the carrier in its said reciprocal movement responsive to pivotal movement of said actuator, said other piece being withdrawable from said one piece and when so withdrawn preventing actuation of said switch, said one piece including an opening therein through which said other piece extends in the assembled condition of said pieces of said actuator, said other piece having means thereon adapted for interfering coaction with means on said housing in one pivoted position of said actuator for preventing withdrawal of said other piece relative to said one piece of said actuator in said one pivoted position of said actuator while permitting withdrawal movement of said other piece relative to said one piece in another pivoted position of said actuator, said means on said other piece being movable therewith through said opening during assembly of said pieces and permitting said assembly of said pieces in only one entry position of said other piece relative to said one piece, said means on said other piece being adapted for interfering coaction with said opening in the event said other piece is rotated to a position different from said one entry position, thereby preventing said assembly of said pieces and wherein said means on said other piece comprises a laterally projecting lug and said means on said housing comprises a shoulder projecting laterally inwardly of said housing, said lug being adapted to be positioned in interfering relation with respect to said shoulder in said one pivoted position of said actuator for preventing withdrawal of said other piece with respect to said one piece, said lug being movable out of interfering relation with respect to said shoulder upon pivotal movement of said actuator to said other pivoted position and permitting withdrawal movement of said other piece from said one piece, said one piece of said actuator comprising a rocker type operating member having trunnion means on the sides thereof received in complementary openings in said housing and pivotally mounting said operating member to said housing, and said other piece of said actuator comprising a head portion projecting upwardly from said operating member and an arm portion extending through said opening and a finger portion extending downwardly from said arm portion and passing into engageable coaction with said carrier for actuating said carrier for its said reciprocal movement, and means on said operating member coacting with means on said arm portion for guiding insertion and withdrawal movement of said other piece relative to said one piece, said withdrawal of said one piece removing said finger portion from coaction with said carrier, thus detaching said actuator from said carrier whereby said one piece can be pivoted about said trunnion means relative to said carrier without resulting in said reciprocable movement of said carrier.

2. A switch in accordance with claim 1 wherein said shoulder is located on a shroud portion of said housing located interiorly thereof and above and said carrier.

3. A switch in accordance with claim 1 wherein said housing includes laterally spaced sides and a said shoulder is located on each of said sides of said housing in oppositely arranged opposed relation, and said other piece includes one said lug on each side thereof for coaction with the respective of said shoulders.

4. An electric switch for controlling electrical energy such as for instance in electric motor driven tools comprising, a housing, a plurality of stationary electrical contacts mounted in said housing, an insulative contact carrier mounted in said housing and being movable relative thereto, movable electric contact means mounted on said carrier for coaction with said stationary contacts, said carrier being reciprocable generally linearly relative to said stationary contacts and thus causing actuation of said switch from "off" to "on" position and vice versa, a rocker actuator pivotally mounted on said housing and coacting with said carrier for causing said movement of said carrier, said actuator being comprised of two pieces, one piece of which is pivoted to said housing and the other piece of which coacts with said one piece and coacts with said carrier for actuating the carrier in its said reciprocal movement responsive to pivotal movement of said actuator, said other piece being removable from said one piece and when so removed preventing actuation of said switch, and wherein said one piece of said actuator comprises a rocker type operating member having lug means on the sides thereof received in complementary openings in said housing and pivotally mounting said member to said housing, and said other piece of said actuator comprising a head portion projecting upwardly from said member, an arm portion passing through an opening in said member, and a finger portion extending downwarding from said arm portion and passing into engageable coaction with said carrier for actuating the carrier for its said reciprocal movement, means on said member coacting with means on said arm portion for guiding insertion and removal movement of said other piece relative to said one piece, and wherein said movable contact means comprises a plurality of elongated contacts each of which is arranged to be moved into engagement with an associated pair of said stationary contacts, said movable contacts and said housing having cooperating camming surfaces, each of said movable contacts being movable between a first position wherein said camming surfaces permit an engaging portion of said movable contact to contact the respective stationary contacts and a second position wherein said camming surfaces separate said engaging portion from one of said respective stationary contacts, said carrier having a central aperture therein through which said finger portion of said other piece of said actuator is received, said aperture having end defining surfaces with the said end defining surfaces of said aperture being sloped in an inward and downward direction for accommodating the angular entry of said finger portion therein during arcuate motion of said finger portion and the conversion thereof into generally linear motion for said carrier, said means on said member comprising downwardly projecting laterally spaced leg portions between which said arm portion is received in guided slidable relation, the lower ends of said leg portions comprising convex arcuate surfces adapted for generally close confronting relation to raised generally horizontal planar surfaces on said carrier.

5. An electric switch for controlling electrical energy such as for instance in electric motor driven tools comprising, a housing, a plurality of stationary electrical contacts mounted in said housing, an insulative contact carrier mounted in said housing and being movable relative thereto, movable electric contact means mounted on said carrier for coaction with said stationary contacts, said carrier being reciprocable generally linearly relative to said housing for moving said movable contact means relative to said stationary contacts and thus causing actuation of said switch from "off" to "on" position and vice versa, a rocker actuator pivotally mounted on said housing and coacting with said carrier for causing said movement of said carrier, said actuator being comprised of two pieces, one piece of which is pivoted to said housing and the other piece of which coacts with said one piece and coacts with said carrier for actuating the carrier in its said reciprocal movement responsive to pivotal movement of said actuator, said other piece being removable from said one piece and when so removed preventing actuation of said switch, means on said other piece adapted for interfering coaction with means on said housing in one pivoted position of said rocker actuator, for preventing withdrawal of said other piece relative to said one piece of said actuator in said one pivoted position of said actuator while permitting withdrawal movement of said other piece relative to said one piece in another pivoted position of said actuator, said means on said other piece comprising a laterally projecting lug and said means on said housing comprising a shoulder projecting laterally inwardly of said housing, said lug being adapted to be positioned in interfering relation with respect to said shoulder in said one pivoted position of said actuator for preventing withdrawal of said other piece with respect to said one piece, said lug being movable out of interfering relation with respect to said shoulder upon pivotal movement of said actuator to said other pivoted position and thus permitting withdrawal movement of said other piece from said one piece and wherein said housing includes laterally spaced sides, with one said shoulder being located on each side of said housing in oppositely arranged opposed relation, said other piece includes one said lug on each side thereof for coaction with the respective of said shoulders, and wherein said one piece has a vertical opening therethrough adapted for receiving said other piece in mounted condition thereon in the assembled condition of said actuator, said other piece having side surfaces, each of said lugs projecting laterally of the respective side surface of said other piece, said opening being so configured that said lugs will pass through said opening to assembled condition of said pieces of said actuator in only one entry position of said other piece relative to said one piece.

* * * * *